US006598801B1

(12) United States Patent
Fortuna et al.

(10) Patent No.: US 6,598,801 B1
(45) Date of Patent: Jul. 29, 2003

(54) METHODS AND APPARATUS FOR INJECTING WATER INTO GAS TURBINE ENGINES

(75) Inventors: Douglas Marti Fortuna, Cincinnati, OH (US); Mark Patrick Kelsey, Cincinnati, OH (US); Neil Sidney Rasmussen, Loveland, OH (US); James Anthony Groeschen, Burlington, KY (US)

(73) Assignee: General Electric Company, Schenectady, NY (US)

( * ) Notice: Subject to any disclaimer, the term of this patent is extended or adjusted under 35 U.S.C. 154(b) by 9 days.

(21) Appl. No.: 09/715,324

(22) Filed: Nov. 17, 2000

(51) Int. Cl.[7] ..... A62C 5/02; B05B 7/10

(52) U.S. Cl. ..... 239/8; 239/403; 239/405; 239/406; 60/39.55; 60/39.58

(58) Field of Search ..... 239/5, 8, 403, 239/405, 406, 418, 419, 423, 424, 433, 590, 590.5, 591, 400, 404; 60/39.53, 39.55, 39.58, 39.59, 742, 748, 728

(56) References Cited

U.S. PATENT DOCUMENTS

| | | | |
|---|---|---|---|
| 2,115,338 | A | 4/1938 | Lysholm |
| 2,625,012 | A | 1/1953 | Larrecq |
| 2,678,531 | A | 5/1954 | Miller |

(List continued on next page.)

FOREIGN PATENT DOCUMENTS

| | | | |
|---|---|---|---|
| CH | 286978 | | 3/1953 |
| EP | 781909 | A2 | 7/1997 |
| EP | 889212 | A2 | 1/1999 |
| FR | 1.007.140 | | 5/1952 |
| GB | 1093682 | | 12/1967 |
| IT | 605502 | | 6/1960 |
| WO | US99/16680 | | 7/1999 |

OTHER PUBLICATIONS

"SPS boosting hot day output by injecting water into compressor" by obert Farmer, *Gas Turbine World*, pp. 35–37, Mar.–Apr. 1999.

Advertisement folder for LM6000 Sprint, GE Industrial AeroDerivatives, One Neumann Way, S–158, Cincinnati, OH 45215–6301.

*Primary Examiner*—Steven J. Ganey
(74) *Attorney, Agent, or Firm*—William Scott Andes; Armstrong Teasdale LLP; Robert B. Reeser, III

(57) ABSTRACT

A nozzle for a gas turbine engine that includes an air circuit, a water circuit, and a swirler that facilitate reducing erosion within the nozzle is described. The air circuit is formed by a first conduit that extends along the nozzle. The water circuit is formed by a second conduit that also extends along the nozzle and is radially inward from the first conduit. Each circuit is in flow communication with a discharge opening. An air swirler adjacent the discharge opening discharges air into water spray exiting the water circuit to facilitate evaporating the water to lower engine operating temperatures.

19 Claims, 3 Drawing Sheets

U.S. PATENT DOCUMENTS 4,094,469 A * 6/1978 Woringer ..... 239/405
4,101,073 A 7/1978 Curran
4,290,558 A * 9/1981 Coburn et al. ..... 239/400
4,301,649 A 11/1981 Walker
4,327,547 A * 5/1982 Hughes et al. ..... 60/39.55
4,395,874 A * 8/1983 Striebel et al. ..... 60/39.58
4,448,018 A 5/1984 Sayama et al.
4,546,923 A * 10/1985 Ii ..... 239/406
4,600,151 A * 7/1986 Bradley ..... 239/400
4,695,245 A * 9/1987 Kotzmann ..... 239/404
4,896,499 A 1/1990 Rice
4,949,544 A 8/1990 Hines
4,984,426 A 1/1991 Santi
4,991,391 A 2/1991 Kosinski
5,011,540 A 4/1991 McDermott
5,072,883 A * 12/1991 Vidusek ..... 239/403
5,390,646 A 2/1995 Swenson
5,463,873 A 11/1995 Early et al.
5,525,268 A 6/1996 Reens
5,535,584 A 7/1996 Janes
5,553,448 A 9/1996 Farrell et al.
5,577,378 A 11/1996 Althaus et al.
5,581,997 A 12/1996 Janes
5,622,044 A 4/1997 Bronicki et al.
5,669,217 A 9/1997 Anderson
5,867,977 A 2/1999 Zachary et al.
5,909,844 A * 6/1999 Nilsson ..... 239/406
5,921,470 A * 7/1999 Kamath ..... 239/418
5,934,555 A * 8/1999 Dobbeling et al. ..... 239/405
6,021,635 A * 2/2000 Gaag et al. ..... 239/400
6,132,202 A * 10/2000 Eroglu et al. ..... 239/405

* cited by examiner

METHODS AND APPARATUS FOR INJECTING WATER INTO GAS TURBINE ENGINES

BACKGROUND OF THE INVENTION

This invention relates generally to gas turbine engines and, more particularly, to methods and apparatus for injecting water into gas turbine engines.

Gas turbine engines typically include a compressor assembly for compressing a working fluid, such as air. The compressed air is injected into a combustor which heats the fluid causing it to expand. The expanded fluid is then forced through a turbine.

The output of known gas turbine engines may be limited by an operating temperature of the working fluid at the output of the compressor assembly. At least some known turbine engines include compressor cooling devices, such as intercoolers, to extract heat from the compressed air to reduce the operating temperature of the flow exiting the compressor. As a result of the decreased temperatures, increased power output may be achieved by increasing flow through the compressor assembly.

To facilitate additional cooling, at least some known gas turbine engines include water injection systems that overcome some of the shortcomings associated with intercoolers. Such systems use a plurality of nozzles to inject water into the flow during engine operation. Each nozzle includes an air circuit and a water circuit which extend through the nozzle. Air and water flowing through each respective circuit is mixed prior to being discharged from the nozzle through a convergent nozzle tip. The air circuit includes a swirler located a distance upstream from the nozzle tip that induces swirling to aid the mixing between the water and the air.

The air exiting the swirler flows a distance downstream before being channeled radially inward within the convergent nozzle tip. As a result, a low pressure, high swirl region is created downstream from the swirler which may trap particulate matter suspended in the air in a continuous swirling vortex. Over time, continued exposure to the swirling particulate matter may cause abrasive erosion to occur within the nozzle tip. Furthermore, any water droplets trapped within the air circuit as a result of condensate from the air system or water drawn into the air circuit from the water circuit, may increase the severity of erosion that occurs.

BRIEF SUMMARY OF THE INVENTION

In an exemplary embodiment, a nozzle for a gas turbine engine includes an air circuit and a water circuit that facilitate reducing erosion within the nozzle. The nozzle air circuit is formed by a first conduit extending along the nozzle. The nozzle water circuit is formed by a second conduit also extending along the nozzle and radially inward from the first conduit. Each circuit is in flow communication with a discharge opening. An air swirler adjacent the discharge opening discharges air towards and into water spray exiting the water circuit. The air swirler induces swirling into air flowing through the air circuit.

During operation, air flows through the air circuit and water flows through the water circuit. Air discharged from the air circuit is swirled with the swirler and impacts water discharged from the water circuit. More specifically, the air helps to atomize the water within the nozzle. The atomized water evaporatively cools a compressor flowpath for engine power augmentation. In one embodiment, the array of droplets evaporate within the engine to facilitate reducing operating temperatures and increasing engine peak power output. Furthermore, because the swirler is adjacent the nozzle discharge opening, swirling airflow immediately impacts the water after being discharged from the swirler. As a result, the swirler facilitates eliminating dwelling of water droplets or particulate matter within the nozzle.

DETAILED DESCRIPTION OF THE INVENTION

Figure 1:
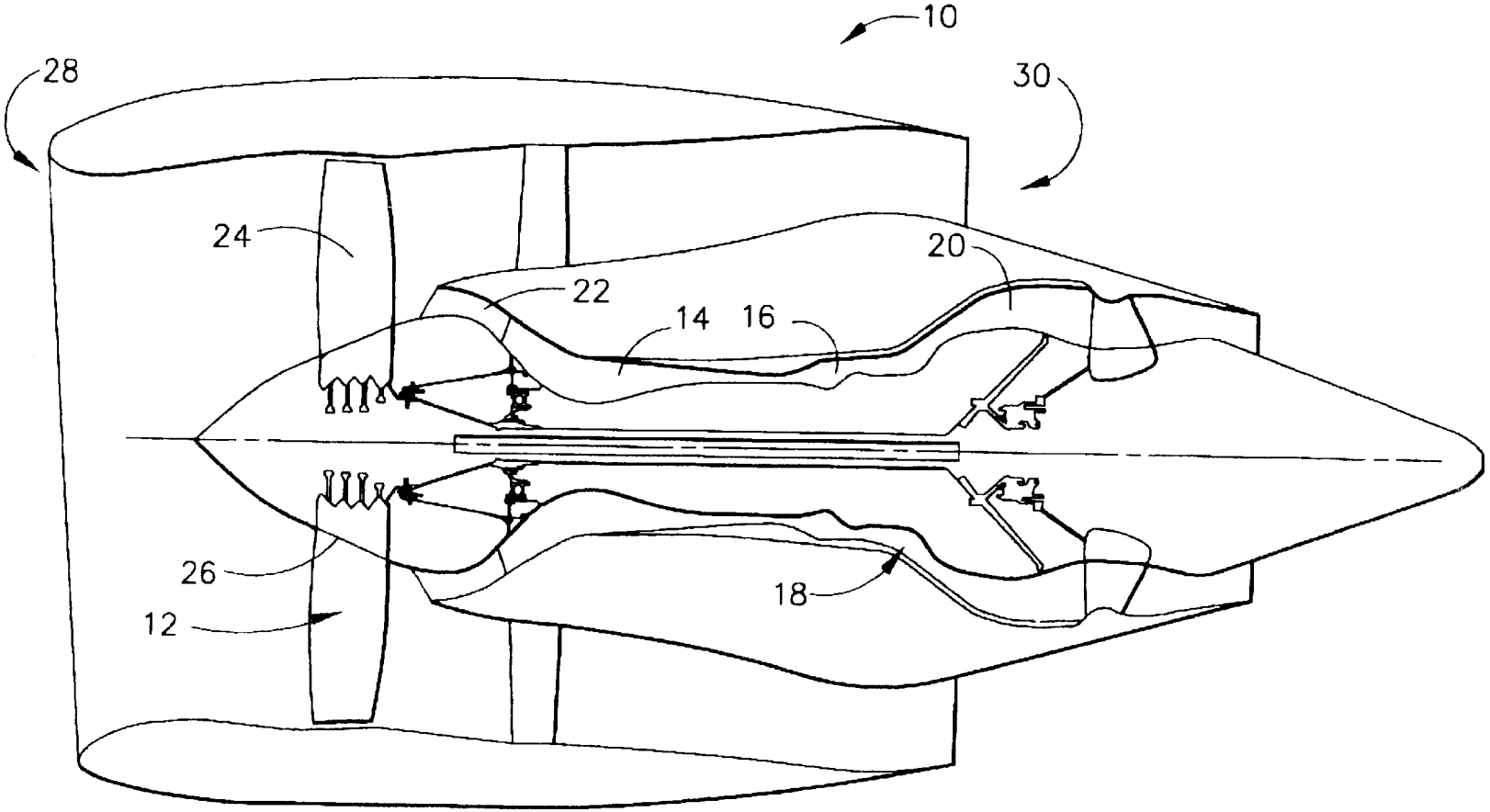
FIG. 1 is a schematic illustration of a gas turbine engine.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20. Compressor 14 is a constant volume compressor and includes a plurality of variable vanes (not shown in FIG. 1) and a plurality of stationary vanes (not shown). Compressor 12 and turbine 20 are coupled by a first shaft 24, and compressor 14 and turbine 18 are coupled by a second shaft 26.

In operation, air flows through low pressure compressor 12 and compressed air is supplied from low pressure compressor 12 to high pressure compressor 14. The highly compressed air is delivered to combustor 16. Airflow from combustor 16 drives rotating turbines 18 and 20 and exits gas turbine engine 10 through a nozzle 28.

Figure 2:
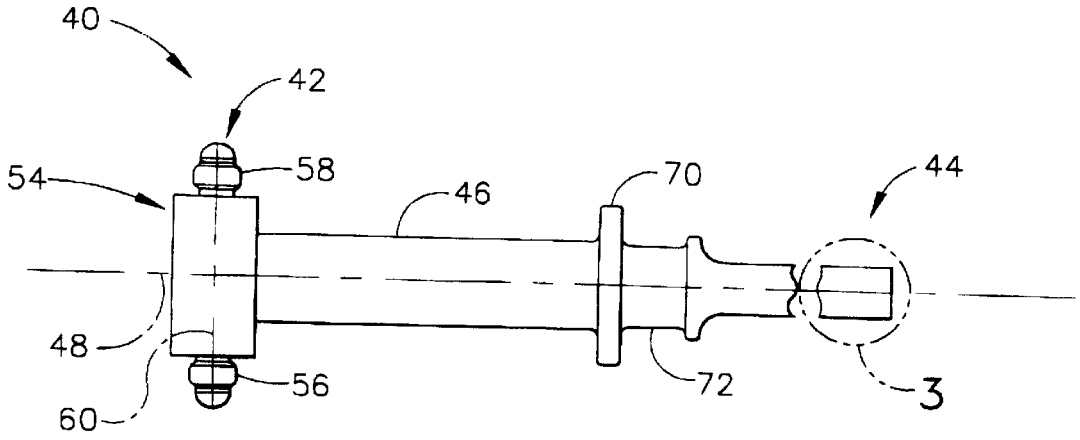
FIG. 2 is side view of an exemplary embodiment of a nozzle that may be used to inject water into the gas turbine engine shown in FIG. 1.

FIG. 2 is side view of an exemplary embodiment of a nozzle 40 that may be used to inject water into a gas turbine engine, such as gas turbine engine 10, shown in FIG. 1. Nozzle 40 includes an inlet end 42, a discharge end 44, and a body 46 extending therebetween. Nozzle 40 has a centerline axis of symmetry 48 extending from inlet end 42 to discharge end 44. Inlet end 42 includes a head 54 including an air nozzle 56 and a water nozzle 58. Inlet end air nozzle 56 couples to an air pipe (not shown) extending from an air source (not shown). In one embodiment, the air source is compressor air. Inlet end water nozzle 58 couples to a water pipe (not shown) extending from a water source (not shown). Inlet end 42 also includes a centerline axis of symmetry 60 extending from inlet end air nozzle 56 to inlet end water nozzle 58.

Nozzle body 46 extends from inlet end such that nozzle body axis of symmetry 48 is substantially perpendicular to inlet end axis of symmetry 60. Body 46 is hollow and includes a mounting flange 70 and a mounting portion 72. Mounting flange 70 is used to mount nozzle 40 to an engine case (not shown) and mounting portion 72 facilitates engagement of nozzle 40 to the engine case.

Figure 3:
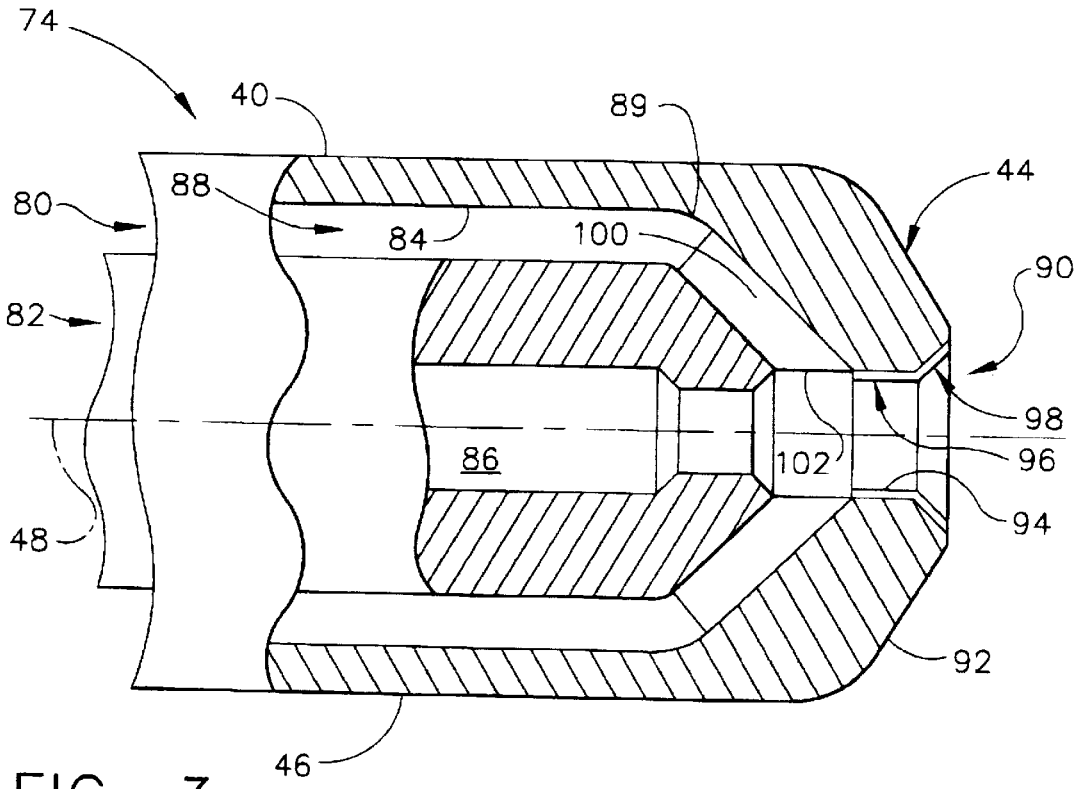
FIG. 3 is an enlarged cross-sectional schematic view of a portion of the nozzle shown in FIG. 2 along area 3.

FIG. 3 is an enlarged cross-sectional schematic view of a portion 74 of nozzle 40. Nozzle 40 includes an air circuit 80 and a water circuit 82. Each circuit 80 and 82 extends from nozzle inlet end 42 (shown in FIG. 2) to nozzle discharge end 44. More specifically, air circuit 80 is formed by an outer tubular conduit 84 and water circuit 82 is formed by an inner tubular conduit 86. Air circuit conduit 84 extends within nozzle 40 from inlet end air nozzle 56 (shown in FIG. 2) to nozzle discharge end 44. Water circuit conduit 86 extends within nozzle 40 from inlet end water nozzle 58 to nozzle discharge end 44. Water circuit conduit 86 is radially inward from air circuit conduit 84 such that an annulus 88 is defined between water circuit conduit 86 and air circuit conduit 84. Fluids flowing within conduits 84 and 86 flow through nozzle body 46 substantially parallel to nozzle centerline axis of symmetry 48.

Nozzle discharge end 44 extends from nozzle body 46. More specifically, nozzle discharge end 44 converges towards nozzle centerline axis of symmetry 48. More specifically, because nozzle discharge end 44 is convergent, air circuit conduit 84 includes a radius 89. As a result of radius 89, air circuit conduit 84 is angled towards nozzle centerline axis of symmetry 48. An opening 90 extends from nozzle outer surface 92 inward along centerline axis of symmetry 48. Water circuit conduit 86 and air circuit conduit 84 are in flow communication with nozzle discharge opening 90.

Opening 90 is defined with nozzle discharge walls 94 such that opening 90 includes an upstream portion 96 and a downstream portion 98. Opening upstream portion 96 is substantially cylindrical, and opening downstream portion 98 extends divergently from opening upstream portion 96. In one embodiment, opening walls 94 are coated with a wear-resistant material, such as, but not limited to a ceramic coating.

An annular air swirler 100 is within nozzle discharge end 44 within air circuit annulus 88. Swirler 100 induces swirling motion into air flowing through swirler 100. Air swirler 100 is downstream from air circuit conduit radius 89 and adjacent nozzle discharge opening 90, such that a trailing edge 102 of air swirler 100 is substantially tangentially aligned with respect to opening upstream portion 96. Furthermore, air swirler 100 is aligned angularly with respect to nozzle centerline axis of symmetry 48. More specifically, air flowing through annulus 88 is channeled through swirler 100 and discharged downstream towards nozzle centerline axis of symmetry 48 and into water circuit 82.

During operation, air flows through air circuit 80 and water flows through water circuit 82. Nozzle 40 uses air in combination with pressurized water to develop an array of water droplets. Air discharged from air circuit 80 through swirler 100 is swirling and impacts water discharged from water circuit 82. More specifically, the air mixes with the water within nozzle 40 and is discharged from nozzle 40 into a gas flow path. The water mixes with the air and evaporatively cools the air flow for engine power augmentation. In one embodiment, the array of droplets evaporate within compressor 14 (shown in FIG. 1), thereby facilitating a reduction in compressor discharge temperature, and as a result, engine peak power output may be increased. Furthermore, because swirler 100 is adjacent nozzle discharge opening 90, the swirling airflow exiting swirler 100 immediately impacts the water droplets. As a result, the swirling airflow facilitates eliminating dwelling of water droplets or particulate matter within nozzle discharge end 44.

Figure 4:
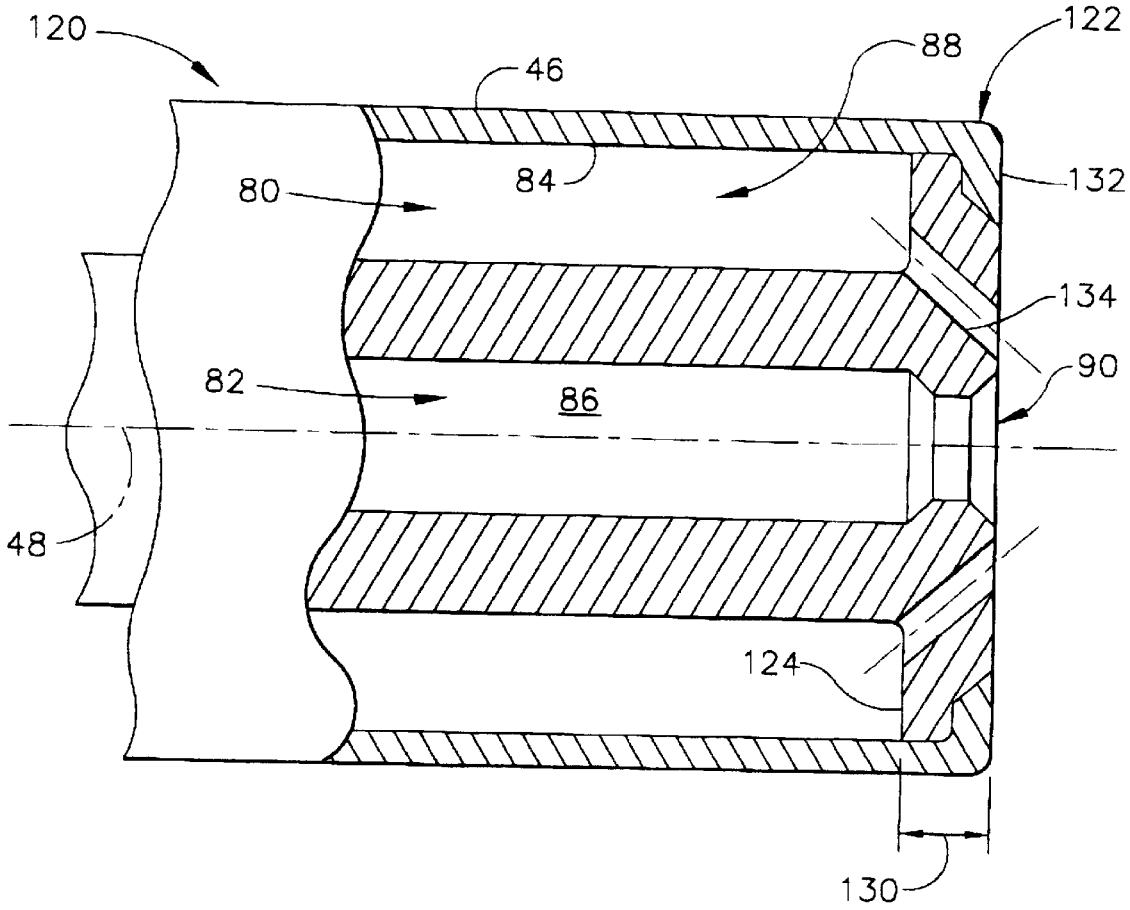
FIG. 4 is an enlarged cross-sectional schematic view of an alternative embodiment of a portion of a nozzle that may be used to inject water into the gas turbine engine shown in FIG. 1.

FIG. 4 is a cross-sectional schematic view of an alternative embodiment of a nozzle 120 that may be used to inject water into a gas turbine engine, such as gas turbine engine 10, shown in FIG. 1. Nozzle 120 is substantially similar to nozzle 40 shown in FIG. 3, and components in nozzle 120 that are identical to components of nozzle 40 are identified in FIG. 4 using the same reference numerals used in FIG. 3. Accordingly, nozzle 120 includes air circuit 80, water circuit 82, and nozzle body 46. Nozzle body 46 extends to a nozzle discharge end 122.

Each circuit 80 and 82 extends from nozzle inlet end 42 (shown in FIG. 3) towards nozzle discharge end 122. More specifically, water circuit conduit 86 extends from nozzle inlet end 42 to nozzle discharge end 122, and is in flow communication with nozzle discharge end opening 90. Air circuit conduit 84 extends from nozzle inlet end 42 towards nozzle discharge end 122 to a conduit end 124. Conduit end 124 is a distance 130 from an outer surface 132 of discharge end 122.

An annular swirler 134 extends in flow communication between discharge end outer surface 132 and air circuit conduit end 124. Swirler 134 induces swirling motion into air exiting air circuit conduit 84. Air swirler 134 is radially outward from nozzle discharge opening 90 and is aligned angularly with respect to nozzle centerline axis of symmetry 48. More specifically, air flowing through annulus 88 is channeled through swirler 134 and discharged downstream towards nozzle centerline axis of symmetry 48 and into water discharged from water circuit 82.

During operation, air flows through air circuit 80 and water flows through water circuit 82. Air discharged from air circuit 80 through swirler 134 is swirling and impacts water discharged from water circuit 82. More specifically, the air mixes with the water downstream from nozzle 122 to cool the air flow for engine power augmentation. In one embodiment, the water and air mix downstream from nozzle 122 and evaporate within compressor 14 (shown in FIG. 1), thereby facilitating a reduction in compressor discharge temperature, and as a result, engine peak power output may be increased. Furthermore, because the water and air mix downstream from nozzle 122, nozzle discharge opening 90 is exposed to only one fluid flow, thus facilitating less erosion to nozzle discharge opening walls 94.

The above-described water injection nozzle is cost-effective and highly reliable. In the exemplary embodiment, the nozzle includes an air swirler positioned adjacent a discharge opening. Air flowing through the nozzle is swirled with the swirler and discharged radially inward to impact water flowing through the nozzle. The swirling air mixes with the water and is discharged from the nozzle. As a result, the nozzle facilitates lowering operating temperatures and increasing performance of the gas turbine engine in a cost-effective and reliable manner.

While the invention has been described in terms of various specific embodiments, those skilled in the art will recognize that the invention can be practiced with modification within the spirit and scope of the claims.

What is claimed is:

1. A method for injecting water into a gas flow stream of a gas turbine engine using a nozzle, the nozzle including an inlet end, a discharge end, and a body extending therebetween, the nozzle also including a first circuit, a second circuit, and a swirler, the swirler in close proximity to the nozzle discharge end, said method comprising the steps of:

routing air from the nozzle inlet end towards the nozzle discharge end using the first circuit;

routing water from the nozzle inlet end towards the nozzle discharge end using the second circuit; and routing at least one of air and water through the swirler adjacent the nozzle discharge end prior to exiting the nozzle discharge end into the gas turbine engine gas flow stream.

2. A method in accordance with claim 1 further comprising the step of routing the first fluid and the water through a discharge opening coated with a wear-resistant material.

3. A method in accordance with claim 1 wherein said step of routing at least one of the first fluid and water through the swirler further comprises the step of routing air through the swirler, such that the air is discharged from the swirler and mixed with the water within the nozzle body.

4. A method in accordance with claim 1 wherein said step of routing at least one of the first fluid and water through the swirler further comprises the step of routing air through the swirler, such that the air is discharged from the swirler and mixed with the water downstream from the nozzle body.

5. A nozzle for injecting water into a gas turbine engine, said nozzle comprising:

an inlet end;

a discharge end;

a body extending between said inlet and discharge ends;

a first circuit extending within said body from said nozzle inlet end to said nozzle discharge end for supplying air to be injected into the gas turbine engine through said nozzle;

a second circuit extending within said body from said nozzle inlet end to said nozzle discharge end for supplying water to be injected into the gas turbine engine through said nozzle; and a swirler in flow communication with at least one of said first and second circuits, said swirler at said nozzle discharge end.

6. A nozzle in accordance with claim 5 wherein said swirler is in flow communication with said first circuit.

7. A nozzle in accordance with claim 5 wherein said nozzle further comprises a centerline axis of symmetry, said swirler configured to discharge fluid towards said nozzle centerline axis of symmetry.

8. A nozzle in accordance with claim 5 wherein said swirler is an air swirler in flow communication with said first circuit.

9. A nozzle in accordance with claim 8 wherein said second circuit is radially inward from said first circuit.

10. A nozzle in accordance with claim 5 wherein said swirler configured such that a first fluid flowing through said first circuit is mixed with the water flowing through said second circuit prior to exiting said nozzle body.

11. A nozzle in accordance with claim 5 wherein said swirler configured such that a first fluid flowing through said first circuit is mixed with the water flowing through said second circuit downstream from said nozzle body.

12. A nozzle in accordance with claim 5 wherein said nozzle discharge end comprises an opening, said opening coated with a wear-resistant material.

13. A water injection nozzle for a gas turbine engine, said nozzle comprising:

a body comprising a discharge opening;

a water circuit within said body and in flow communication with said discharge opening;

an air circuit within said body and in flow communication with said discharge opening; and a swirler within said body in close proximity to said discharge opening, said discharge opening for injecting at least one of water and water atomized by air into the gas turbine engine.

14. A water injection nozzle in accordance with claim 13 wherein said discharge opening coated with a wear-resistant material.

15. A water injection nozzle in accordance with claim 13 wherein said swirler in flow communication with at least one of said water circuit and said air circuit.

16. A water injection nozzle in accordance with claim 13 wherein said water circuit is radially inward from said air circuit, said swirler in flow communication with said air circuit.

17. A water injection nozzle in accordance with claim 16 further comprising a centerline axis of symmetry, said swirler configured to discharge air towards said nozzle centerline axis of symmetry.

18. A water injection nozzle in accordance with claim 16 wherein said swirler configured such that air discharged from said swirler is mixed with water within said nozzle body.

19. A water injection nozzle in accordance with claim 16 wherein said swirler configured such that air discharged from said swirler is mixed with water downstream from said nozzle body.

* * * * *